US009146022B2

(12) United States Patent
Moser et al.

(10) Patent No.: US 9,146,022 B2
(45) Date of Patent: Sep. 29, 2015

(54) DEVICE FOR FASTENING AND CONTACTING A LIGHTING MEANS AND/OR A LIGHTING MODULE, AND LAMP

(75) Inventors: Peter Moser, Stans (AT); Thomas Riedler, Baumkirchen (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 23 days.

(21) Appl. No.: 13/824,701

(22) PCT Filed: Sep. 20, 2011

(86) PCT No.: PCT/AT2011/000384

§ 371 (c)(1),
(2), (4) Date: Jun. 10, 2013

(87) PCT Pub. No.: WO2012/037588

PCT Pub. Date: Mar. 29, 2012

(65) Prior Publication Data

US 2013/0286669 A1 Oct. 31, 2013

(30) Foreign Application Priority Data

Sep. 20, 2010 (AT) ..... GM590/2010
Dec. 3, 2010 (AT) ..... GM743/2010

(51) Int. Cl.

| | |
|---|---|
| ***F21V 17/00*** | (2006.01) |
| ***F21V 19/00*** | (2006.01) |
| ***F21V 17/10*** | (2006.01) |
| ***F21V 17/16*** | (2006.01) |
| ***F21V 17/18*** | (2006.01) |
| ***F21V 23/06*** | (2006.01) |

(52) U.S. Cl.

CPC ..... *F21V 17/10* (2013.01); *F21V 17/16* (2013.01); *F21V 17/18* (2013.01); *F21V 19/001* (2013.01); *F21V 19/0025* (2013.01); *F21V 19/0035* (2013.01); *F21V 23/06* (2013.01)

(58) Field of Classification Search

CPC ..... F21V 21/04–21/049; F21V 17/16–17/168; F21V 17/002; F21V 19/001–19/0055

USPC ..... 362/294, 373

See application file for complete search history.

(56) References Cited

U.S. PATENT DOCUMENTS

| | | | | |
|---|---|---|---|---|
| 5,738,436 | A * | 4/1998 | Cummings et al. | 362/294 |
| 6,787,999 | B2 * | 9/2004 | Stimac et al. | 362/800 |
| 7,540,761 | B2 * | 6/2009 | Weber et al. | 362/373 |

(Continued)

FOREIGN PATENT DOCUMENTS

| | | | |
|---|---|---|---|
| EP | 2284440 | A1 | 2/2011 |
| JP | 9320327 | A | 12/1997 |
| JP | 11066941 | A | 3/1999 |

(Continued)

*Primary Examiner* — Mariceli Santiago

(74) *Attorney, Agent, or Firm* — Volpe and Koenig, P.C.

(57) ABSTRACT

A device is provided for fastening and contacting a lighting device and/or a lighting module. The device is preferably fastened to a heat sink, and the lighting device and/or the lighting module, is fastened in the device. The device has at least one outer element as a retaining ring and at least one inner element and/or spring element, and or at least one electrical contacting part.

20 Claims, 8 Drawing Sheets

(56) References Cited

U.S. PATENT DOCUMENTS

| | | | | |
|---|---|---|---|---|
| 7,988,336 | B1 * | 8/2011 | Harbers et al. | 362/294 |
| 8,152,336 | B2 * | 4/2012 | Alexander et al. | 362/294 |
| 8,414,178 | B2 * | 4/2013 | Alexander et al. | 362/294 |
| 2007/0279921 | A1 * | 12/2007 | Alexander et al. | 362/373 |
| 2009/0207623 | A1 * | 8/2009 | Schutte | 362/365 |
| 2011/0267826 | A1 * | 11/2011 | Santiago et al. | 362/365 |

FOREIGN PATENT DOCUMENTS

| | | | |
|---|---|---|---|
| JP | 2007005193 | A | 1/2007 |
| WO | 2007128070 | A1 | 11/2007 |
| WO | 2008133889 | A1 | 11/2008 |

* cited by examiner

Fig.15a
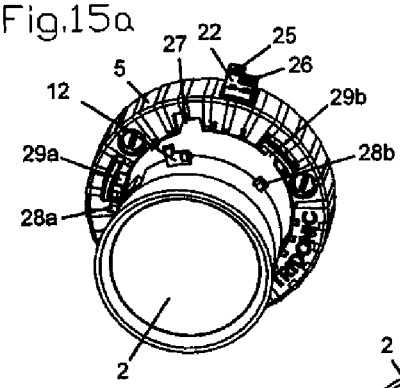
Fig.15b
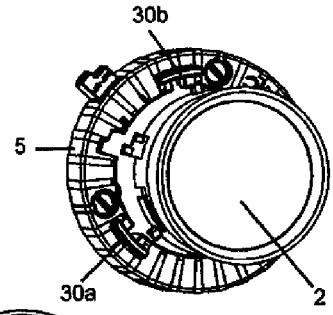
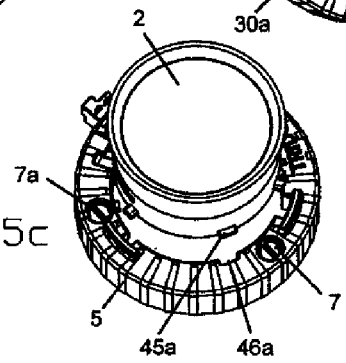
Fig.15c
Fig.16
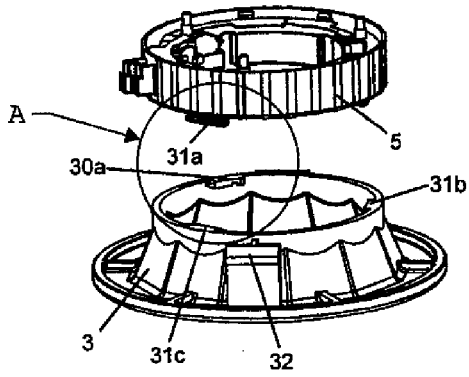
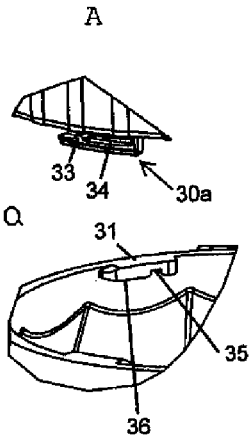
Fig.16a

DEVICE FOR FASTENING AND CONTACTING A LIGHTING MEANS AND/OR A LIGHTING MODULE, AND LAMP

FIELD OF THE INVENTION

The invention relates to a device for fastening and contacting a lighting means and/or a lighting module, in particular an LED module, as well as a lamp, in particular a downlight, provided with such a device.

BACKGROUND

Similar devices are used to attach at least one light source and/or a light module and to contact them with a voltage supply. They are also connected to a lamp.

Devices for LED modules, known as LED light engines, are known from the prior art, which make it possible to press the rear side of the module onto the surface of a heat sink. This should be done with a defined force to ensure the necessary dissipation of heat. The lifespan of the LED is influenced in this manner. The device is provided with a first outer ring and with an inner ring, which is mounted with several compression springs, screws and washers in the outer ring. The back of the LED module is thus pressed with the resilient mounting of the inner spring onto a heat sink. The inner ring must be made of a plastic material that is resistant to high temperature due to the heat generated by the LED module. This is disadvantageous for cost reasons.

A disadvantage is that the device consists of several individual parts and that the force pressing the LED module in is not adjustable or variable.

It is also known from the prior art that such devices allow for electrical connection between the LED circuit board and the electric power supply, preferably as electrical conductors. The electrical contact can be provided for example with two sliding contacts, arranged on the one hand on both side of the board, and on the other hand on the connecting means for the electrical conductors or wires. These sliding contacts of the same type are arranged preferably in a chamber at a distance from each other, and/or opposite each other and/or laterally shifted in order to achieved a defined contact position.

The disadvantage here is that a large amount of space is required for the arrangement, in depth and in width.

Finally, the heat sink is typically connected with the lamp. This is disadvantageous because undesirable heating of the lamp through the contact with the warm heat sink can occur. Moreover, the entire system must be dismantled if the LED module is to be replaced.

SUMMARY

The object of the invention is to provide a device for fastening and contacting a lighting means and/or a lighting module, in particular an LED module, designed and developed in such a way that the disadvantages mentioned above are eliminated, while the construction of the device is simplified and the assembly of the lighting means and/or of the lighting module is improved. For this purpose, the electrical contact between the circuit board of the lighting means and/or the lighting module and electrical conductors or electrical voltage supply connections can be achieved with a space saving design and the fixing of the light to the system, device and heat sink can be performed in performed in a simpler manner.

This objective is achieved according to the invention as described in the characteristics of the independent claims.

The device for fastening and contacting a lighting means and/or a lighting module, in particular an LED module, is preferably fixed to a heat sink, and the lighting means and/or lighting module, in particular an LED module, is preferably fixed in the device.

An essential characteristic is that the device is provided with at least one outer member and at least one mounting ring, and at least with one inner element and/or spring element, and/or at least one electrical contacting part.

The terms "outer element" and "mounting ring" will be hereinafter used alternatively as they describe comparable elements of the different embodiments of the device.

The device for fastening and contacting a lighting means and/or a lighting module, in particular an LED module, is equipped with at least one outer element and one inner element, so that the inner element is positioned with the spring means on the outer element, wherein the lighting means and/or the lighting module, in particular an LED module, is mounted in the device.

In one embodiment of the invention, it is essential that the inner element be positioned with a spring means on the outer element. It is also essential that the inner element be designed with a resilient construction.

In this embodiment, the inner element according to the invention does not have to be mounted on the outer element as it can be supported only on the outer element.

The inner element may be formed as a spring clip, wherein one or several spring elements are provided, preferably as spring legs, in the inner element. These spring elements press against the outer element at least in the direction of the assembly of the LED module. The LED module can thus be fixed in the device by being pressed against the heat sink, which may be arranged on or behind the device.

The inner element is designed as a resilient member, wherein the inner element itself contains a resilient element or is designed as a resilient element.

The advantage here is that the spring elements are integrated in the inner element. A significant reduction of the assembly costs is thus achieved by minimizing the number of the required individual components.

Another advantage is that the force can be adjusted with the spring clip better than with additional predefined springs in order to press the light module, in particular LED module, onto the heat sink. Depending on the lighting means and/or the lighting module, a force in the range of approximately 25 N to 50 N is required for the pressing force.

Also, a reversal should not be excluded. The spring elements can be formed integrally with the outer element and they should press on the inner element.

It is also essential that the inner element should consist of a heat dissipating material. An inner element made of metal, for example chrome-nickel, can be subjected to punching and/or bending.

A similar inner element has the advantage that improved heat dissipation can be achieved from the LED module with a specially formed spring element, so that on the spring element is placed a heat sink consisting for example of aluminum, since a direct connection of the heat sink with the LED module can be provided via the spring clip.

One connection, preferably a mechanical connection or contact, can be provided between the inner element and the heat sink. It could be provided in the form of bars or brackets which are in contact with the heat sink. The greater the contact surface, the better the heat dissipation.

According to one embodiment of the invention, the fastening means for the lighting means and/or lighting module, in particular an LED module, are provided in the device. It is preferable when a tool-free assembly is offered. Preferably, the fastening means in the inner element are represented by a locking element, in particular a mechanical locking element, for a retaining means for the lamp on the lighting means and/or lighting module, in particular an LED module.

The fixing of the lighting means and/or lighting module, in particular an LED module, can be performed based on a principle that is per se known. When the outer and inner elements are formed as rings, the principle of a bayonet mount can be employed.

For example, projections can be arranged as a holding means at the lighting means and/or lighting module, in particular an LED module. Corresponding recesses can be provided in the outer element of the device, so that the lighting means and/or lighting module, in particular an LED module, can be inserted into the device.

Guide elements can be provided in the inner element of the device, preferably as a slotted guide, which are used to guide the retaining means of the lighting means and/or lighting module, in particular an LED module. A similar locking element of the lighting means and/or lighting module, in particular an LED module, in the device can by realized with a latching notch, preferably a stamped one.

The latching notch in the spring clip according to the invention is advantageous because it is substantially better resistant to wear than a latching notch in an inner element according to prior art which is made of a plastic material.

Furthermore, a device for fastening and contacting a lighting means and/or a lighting module, in particular an LED module, is provided which has at least one holding ring and at least one spring element, wherein the device is preferably attached to a heat sink so that the lighting means and/or the lighting module, in particular an LED module, is mounted in the device.

An essential characteristic of another embodiment of the invention is that at least one spring element is formed as a leaf spring.

It is preferred when multiple, preferably three equal spring elements are used which are equally distributed in the mounting ring. The spring elements are used in this embodiment as an inner element. This can make it easier in some cases in order to form the spring elements than when only a single spring element is used as an inner element.

The advantage here is again that force can be generated on the lighting means and/or lighting module, in particular an LED module, by means of at least one spring element. The lighting means and/or lighting module, in particular an LED module, can thus be pressed onto the heat sink. The contact pressure of 25 N to 50 N for a lighting means and/or lighting module, in particular an LED module, can be achieved on the heat sink.

The leaf spring can be provided with a spring leg so that for example two spring legs can be provided, each of them being arranged laterally to the anchoring point of the spring element.

The spring legs of the spring element can be supported in accordance with the invention on the mounting ring. Attachment between at least one spring leg and the mounting ring is not necessary if otherwise a permanent connection is provided between the spring element and the rest of the connection.

It is preferred when the device is attached to the heat sink with screws used as a fastening means. For example three screws can be used, which can be arranged in a uniform pattern around the mounting ring.

At least one spring element is arranged on the fastening means of the device. A single leaf spring can be provided, for example arranged on one or several screws. In a preferred embodiment of the invention, one spring leaf is use per each fastening means. Three individual leaf springs are provided in this case.

In addition, at least one holding means can be provided in order to avoid losing the mounting ring during assembly of the lighting means and/or lighting module, in particular an LED module. This also provides a preventive measure which limits the maximum movement of the spring element in vertical direction.

According to this embodiment of the invention, the means for fastening the lighting means and/or lighting module, in particular an LED module, are provided in the device. It is preferable to offer a tool-free assembly. Preferably, the fastening means, in particular a mechanical locking element, is provided for the retaining means on the lighting means and/or lighting module, in particular an LED module.

The fastening of the lighting means and/or lighting module, in particular an LED module, can be performed according to a principles that is per se known. For example the principle of a bayonet mount can be employed.

For example projections can be arranged as a holding means on the lighting means and/or lighting module, in particular an LED module. In the mounting ring can be provided corresponding recesses so that the lighting means and/or a lighting module, in particular an LED module, can be inserted into the device.

In the mounting ring, guide elements can be provided, preferably in the form of a slotted guide, which are used to guide the retaining means of the lighting means and/or a lighting module, in particular an LED module. One possible locking element of the lighting means and/or lighting module, in particular an LED module, can be realized in the device with a locating projection.

The retaining means on the spring element can be designed for example as a tab with a hook. During the assembly of the lighting means and/or lighting module, in particular an LED module, the mounting ring is lifted from the heat sink. The spring element or elements hold on one side the mounting ring and press the leaf spring or leaf springs with its spring legs on the other side of the mounting ring in the direction of the heat sink, so that the lighting means and/or lighting means, in particular an LED module, is pressed onto the heat sink.

At the lighting means and/or lighting module, in particular an LED module, other additional elements may be provided for the embodiment of the invention, for example coding elements, and fitting counterparts can be provided in the device. The form of the coding elements may depend on the type of the lighting means and/or lighting module, in particular an LED module, and on the type of the device. It can be for example coding for different performance levels or voltages, including for 120 V or 230 V.

It is also advantageous for the embodiment of the invention when the rear side of the lighting means and/or lighting module, in particular an LED module, is provided with a protective film so that the lighting means and/or lighting module, in particular an LED module, can be better rotated based on the bayonet mount principle on the contact surface of the heat sink.

The device for fastening and contacting the lighting means and/or lighting module, in particular an LED module, is provided with at least one electrical contact between the lighting means and/or lighting module, in particular an LED module, and at least one electrical conductor or a connection to electric power supply, wherein the electric contact is provided with contact elements which are arranged in the device and are on their longitudinal side on the one hand in contact with the lighting means and/or lighting module, in particular an LED module, preferably an LED printed circuit board, and on the other hand they are also in contact with the electrical conductor or the electrical power supply.

The terms "contact point" and "contacting part" are used in the following text alternatively and indicate comparable elements of different embodiments in their function in the device.

Another essential characteristic of the embodiment of the invention is that the respective edgewise sides of the contact elements are arranged in the mounting direction of the lighting means and/or lighting module, in particular an LED module.

Additionally or alternatively, the contact elements may be arranged in separate chambers in the contacting location in order to prevent an undesirable contact between the contact elements.

This has the advantage that the design for electrical contacting is substantially smaller and space-saving in the device. The characteristics according to the invention make it possible to create a very narrow and short design. This is particularly relevant in applications with a small space requirement. This can thus be used for example to create relatively smaller holes in the ceiling.

When the two contact points on the circuit board, in particular an LED circuit board, are arranged mutually shifted, the contact elements will be also shifted relative to each other, as well as the connections for the electrical conductors or power supply connections. This shifting or offset can be advantageously used also for polarity protection for the electrical contacts.

The contact elements can be inserted in the circuit board, or they can be also clamped in the circuit board.

The power supply connection may be designed for instance in the form of connecting wires, as electrical conductors, or as a plug. The contact between the contact elements, the electrical conductors and the electrical power supply can be realized according to a known method, so that for example the electrical conductors or the connecting wires are inserted into the contact device and pressed against the contact elements.

According to another embodiment of the invention, the device is equipped for fastening and contacting of a lighting means and/or of a lighting module, in particular of an LED module, with at least one mounting ring and at least one contacting part arranged between the lighting means and/or lighting module, in particular an LED module, and the electrical conductors, wherein the electrical contacting part is arranged on the mounting ring or connected with the mounting ring and equipped with contact elements which on the one hand are in contact with the lighting means and/or lighting module, in particular an LED module, preferably with an LED circuit board, and on the other hand are in contact with electrical conductors.

An essential characteristic of this embodiment is that the contacting part is integrated in the mounting ring.

The advantage here is that such a device is very compact, even more compact that the embodiment described above.

It is also essential that the contacting part be arranged, at least when seen in the radial direction within the outer contour of the mounting ring, or of the standard maximum diameter or the maximum diameter which is defined as a standard of the mounting ring. When the contacting part is not considered as protruding from the mounting ring, or as protruding beyond the mounting ring, a space saving design can be achieved for the device, for the lighting and also in the ceiling.

The contacting part can be manufactured integrated with or in the mounting ring, or it can be designed as a separate part which can be mounted in the mounting ring.

When the device is used in a housing, the outer diameter can be only as large as the outer diameter of the housing, or the outer contour of the device. For example a cylindrical lamp with a diameter suitable for the mounting ring can be used. The diameter of the lamp should preferably not be greater than the protrusion of the contacting part which is per se known.

To prevent a detrimental influence on the inner and outer diameter of so far known mounting rings, while nevertheless achieving an integrated solution for the contacting part, the contacting part can, according to one embodiment, be positioned obliquely in the mounting ring.

Preferably, the contacting part is arranged obliquely to the radial and tangential direction, which is to say that the contacting part can be arranged at an angle to the radial direction of the mounting ring, wherein the angle can be larger than 0° and smaller than 90°, or not 0° or 90°. In principle, the contacting part could be arranged obliquely to either one or several directions depending on the size of the contacting part and of the mounting ring. The contacting part can be also arranged almost tangentially in the mounting ring.

To ensure interchangeability and/or compatibility between and with different devices, lighting means, in particular LED modules, and lamps, norms and standards have been established. For example the nominal or maximum diameter of the mounting ring is defined (as an example, a standard is provided for a device having a nominal diameter of 95 mm and a maximum diameter of 96 mm), as well as the maximum projection of the contacting part. However, it is advantageous when the contacting part has no additional projection above the maximum diameter of the mounting ring. Nevertheless, it would be still possible that the device could be provided with a projection of the contacting part when the outer contour or the diameter of the mounting ring is smaller than the maximum diameter of the mounting ring which is defined as the nominal diameter, and if the entire dimension of the device with the projection is not greater than the maximum diameter of the mounting ring or the diameter defined as nominal diameter. These options should be taken into consideration for the entire invention. Specifically, it should be understood in particular that the term outer contour (outline) of the mounting ring should be in particular understood as the defined nominal standard, or as the maximum diameter of the mounting ring, unless specified otherwise when appropriate.

Additionally or alternatively, the contact elements may be arranged in separate chambers in the contacting location in order to avoid undesirable contact between the contact elements.

This has the additional advantage that the design for the electrical contacts in the device is significantly smaller and compact. The characteristics according to the invention make it possible to create a very narrow and short design. This is particularly relevant with application with minimal small requirements. It is thus possible to make relatively small holes for donwnlights in the ceiling.

When the contact points are on a circuit board, in particular an LED circuit board, they are arranged shifted so that the contact elements are shifted with respect to each other, as well as the connections for the electrical conductors. This shifting can be advantageously used also for reverse polarity protection for electrical contacts.

The contact elements can be inserted into the circuit board or they can be also clamped in the circuit board.

It can be also advantageous when not only the contacting part, but also the electrical conductor, at least in the assembled state, is not considered as protruding in radial direction over the outer diameter, or over the outer contour of the mounting ring, or over the maximum diameter of the mounting ring which is defined as standard. This makes it possible to maintain the space saving design on the periphery of the mounting ring.

However, it should be still possible for the electrical conductors to be inserted laterally for the assembly, outside of the outer contour of the mounting ring, into the socket holes of the contacting part.

Depending on the design of the mounting ring, it could be also conceivable that the electrical conductors are protruding in the radial and/or tangential direction from the mounting ring, but do not come out of the outer contour of the mounting ring—for example, a redundancy may be provided for the electrical conductors at the mounting ring.

It is preferred that no conductor guiding region exceeds the outer diameter of the mounting ring.

The electrical conductors can be bent out of the contacting part and they will not protrude outside the mounting ring seen in the radial direction over the outer contour of the mounting ring, or of the standardized or as standard defined maximum diameter of the mounting ring.

The electrical conductors can be inserted both horizontally to the radial and tangential direction, or along the longitudinal axis of the contacting part into the plug holes, but they can also be subsequently moved vertically, which is to say tangentially to the mounting ring, within the outer diameter of the mounting ring.

The electrical conductors can be for example bent out of the contacting part below or above the mounting ring, for example below the rear side of the mounting ring.

Another possibility is that the electrical conductors can be bent laterally along the mounting ring.

It is preferred that the electric conductors, when they leave the mounting ring, do not extend beyond the outer contour of the mounting ring or of the standardized maximum diameter or a diameter defined as standard of the mounting ring.

According to one embodiment of the invention, no open electrical conductors are provided. The electrical conductors can be covered. For example, a cover or a metal body can be mounted around the device.

Instead of conductors or wires, it is also possible to use a plug. The plug should be also designed in such a way that it does not extend over the outer diameter of the mounting ring.

Another characteristic of the invention is that means can be attached above the heat sink, preferably made of aluminum, in order to fasten the connecting lines. The means can be preferably provided with terminals and cable clamps. The means can be secured for example with a bracket on the heat sink.

Another essential characteristic of the invention is that the device for fastening and contacting a lighting means, in particular an LED module, is connected to a lamp. The device is provided with fastening means for the lamp arrangement. For example a downlight lamp can be used for the lamp.

The fastening may preferably enable a tool-free connection with the lamp, preferably by means of a snap connection or a bayonet mount.

The installation of the lamp directly on the device has the advantage that the lamp is no longer in direct contact with the heat sink. This makes it possible to reduce occurrences of temperature-related problems of the lamp. Also, less expensive material can be used for the lamp in this case.

A further advantage is that the lighting means and/or light module, in particular an LED module, can be removed directly from the device and replaced without having to disassemble the lamp.

On the device are provided for example at least two locations with fastening means. These may be catching projections, and the lamp is equipped with hooks which can be snapped into the latching projections. The fastening means can be also equipped with a slotted guide and catching projections, or with a latching notch in a counterpart for fastening by means of a bayonet mount. The fastening means may be integral with the device, or they can be provided as a separate element so that they can be exchanged in order to be compatible with different lamps.

The invention also relates to a lighting means of a lighting module, in particular an LED module, as well as to a lamp provided with the device according to the invention.

BRIEF DESCRIPTION OF THE DRAWINGS

The invention will now be described in more detail based on embodiments, which, however, are intended to be merely exemplary without being restrictive.

The figures show the following:

FIG. 15*a*, FIG. 15*b* and FIG. 15*c*: perspective views of the first device according to the invention provided with an LED module during the assembly.

FIG. 16: an exploded view of the first device according to the invention provided with a zoomed-in view of the fastening means shown in FIG. 16*a*.

DETAILED DESCRIPTION OF THE PREFERRED EMBODIMENTS

Figure 1:
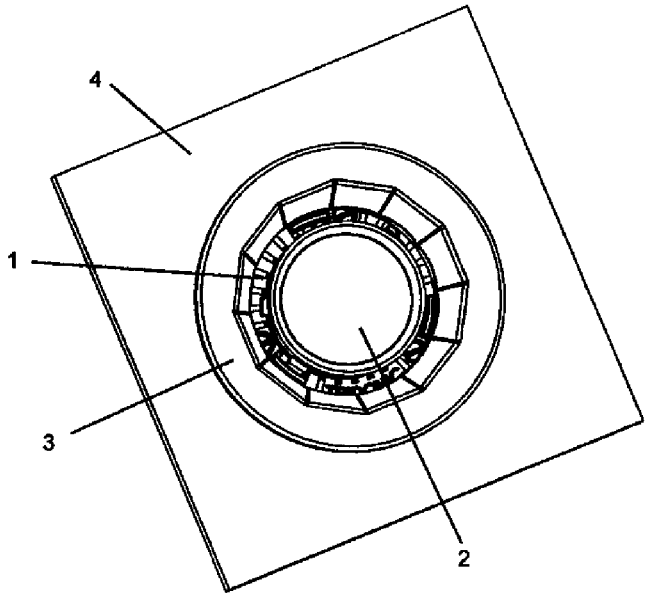
FIG. 1: a perspective view of a lamp provided with a first device according to the invention.

FIG. 1 shows the system in assembled state. It is a downlight lamp, wherein the lamp 3 is attached to the ceiling 4 (only partially shown here). The device 1, which has here the form of a mount, is attached to the lamp 3. An LED module 2 is indicated here as a lighting means and/or a lighting module. This LED module 2 is mounted in the LED mount, or in the device 1.

Other lamps can be also used—a downlight lamp is indicated here merely by way of an example.

Figure 2:
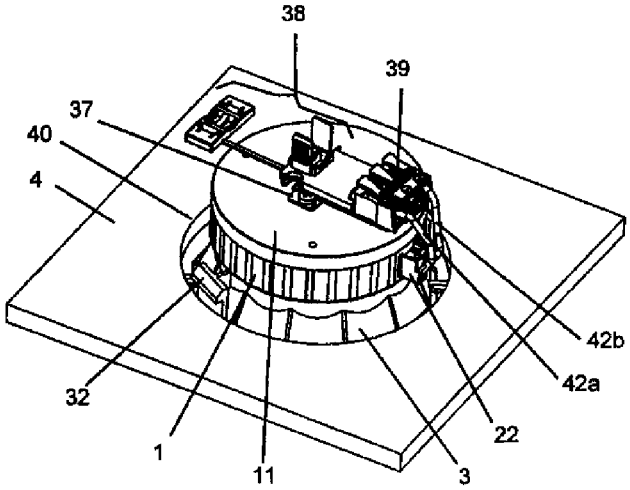
FIG. 2: a perspective view of a rear side of the lamp provided with the first device according to the invention.

FIG. 2 shows, in schematic representation, the rear side of the system behind the ceiling 4. The lamp 3 can be fastened for example with one or several hooks 32 which are attached to the ceiling 4. On the ceiling 4, not shown here, can be provided an additional fastening means in order to compensate for differences in ceiling thicknesses. The hook 32 will then be engaged in the fastening means, not shown here.

On the rear side of the device 1 a heat sink 11 is schematically indicated, which is preferably made of aluminum and which is required when LEDs or LED modules are used in order to dissipate the heat generated by the LEDs.

In the contacting point 22 of the device 1 are inserted connecting wires 42*a* and 42*b* for the supply voltage. These connecting wires 42*a* and 42*b* can be also joined as shown here with clamps 39, connected to other lines, not indicated here, and also connected with a power supply or with another system. These lines, not shown here, are arranged in a strain relief unit 38, and the clamps can be attached for example by means of a bracket 37 to the rear side of the heat sink 11.

Figure 3A:
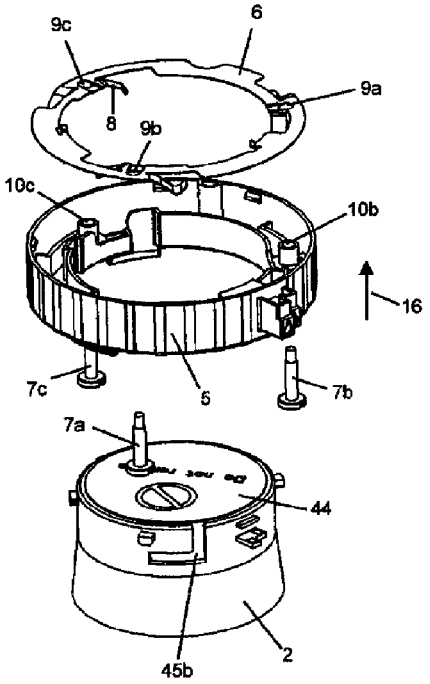
FIG. 3*a* and FIG. 3*b*: an exploded view of the first device according to the invention provided with an LED module.
Figure 3B:
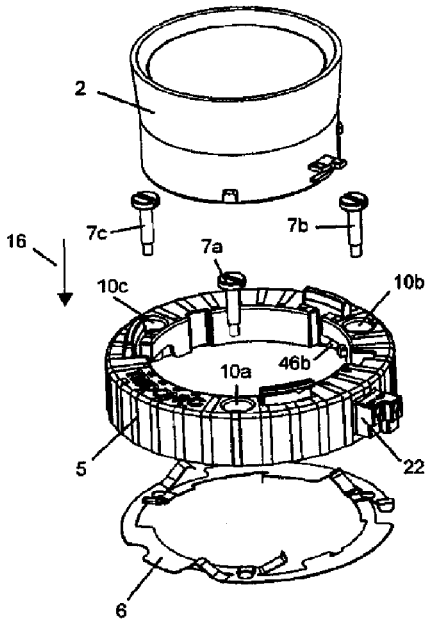

In FIGS. 3*a* and 3*b*, is illustrated the device 1, which is shown here as an LED mount, wherein the individual parts of the LED module 2 are indicated. The device 1 is equipped with an outer element, provided here for example as an outer ring 5, and with an inner element, provided here for example as an inner ring 6 and screws 7*a*, 7*b*, and 7*c*.

The screws 7*a*, 7*b*, 7*c* are screwed into threads 10*a*, 10*b*, 10*c*, through holes 9*a*, 9*b*, 9*c* to the heat sink 11, and they fasten the device 1 to the heat sink 11.

The inner ring 6 is located on the outer ring 5. The inner ring is equipped on its outer region with spring legs 8*a*, 8*b*, 8*c*, which are supported in the outer ring. The inner ring 6 is thus loosely positioned in the direction of the assembly in the mounting ring 6.

Figure 4:
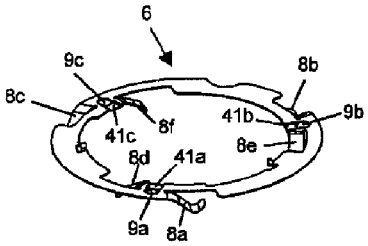
FIG. 4: a perspective view of the inner element of the first device according to the invention.

FIG. 4 illustrates the inner ring 6 according to the invention. The inner ring 6 is in accordance with the invention resilient and it can be preferably provided in the form of a spring clip. The inner ring 6 can be made of chrome-nickel and it can be stamped and bent. The spring legs 8*a*, 8*b*, 8*c* are uniformly distributed in the vicinity of the outer region of the inner ring 6. This allows an improved suspension and a better support for the inner ring 6 in the outer ring 5.

This has the advantage that fewer structural parts are required for the device 1.

The inner ring 6 is provided with a mechanical contact in the form of bars or tabs to the to the heat sink 11. This allows for improved heat dissipation. The LED module 2 is supported by the inner ring 6 and the LED module is thus pressed by the spring force of the inner ring 6 onto the heat sink because the resilient inner ring 6 is loosely positioned in the assembly direction 16. Therefore, the surface of the rear side 44 of the LED module 2 is applied with a sufficient force to the surface of the heat sink 11 to improve heat dissipation.

To the rear side 44 of the LED module 2 can be attached a protective film so that on the one hand, the LED module 2 will not be damaged during the assembly, and on the other hand, both surfaces (the rear surface of the LED module and the surface of the heat sink which come into contact with each other) can better slide relative to one another when the LED module 2 is rotated.

The spring force of the inner ring 6 can thus be adjusted thanks to the construction of the inner ring 6 which is equipped with the spring legs 8*a*, 8*b*, 8*c*. Different pressure forces will be required depending on the LED module 2.

During the assembly of the LED module 2, the projections 28*a*, 28*b*, 28*c* of the LED module 2 are guided on the preferably resilient slotted guides 8*e*, 8*f*, 8*g* in the inner region of the inner ring 6 and they are snapped into the latching notches 41*a*, 41*b*, 41*c* in order to fasten the LED module 2 in the device 1.

The assembly position of the LED module 2 in the device 1 is illustrated in FIGS. 15*a*, 15*b*, 15*c*.

The LED module 2 is equipped with a retaining means illustrated here as projections 28*a*, 28*b*, 28*c*, which are arranged in the vicinity of the LED module 2. These projections 28 may form a part of an aluminum plate in the LED module 2 which is required as an internal heat sink of the LED module 2. In the outer ring 5 are provided notches 29*a*, 29*b*, 29*c* for this retaining means 28. A recess 27 for the LED circuit board 12 of the LED module 2 is created also in the outer ring 5.

Here, the bayonet mount principle is used for the assembly of the LED module 2 in the LED mount 1. The retaining means 28 and the LED circuit board 12 of the LED module 2 are inserted into the matching recesses 29 and 27 of the outer ring until the projections come to a stop at the resilient inner ring 6 with the slotted guides 8*e*, 8*f*, 8*g*. The LED module 2 is then rotated, whereby the projections 28*a*, 28*b*, 28*c* will first glide on the spring legs 8*d*, 8*e*, 8*f* on the inner side of the inner ring 6, until the projections 28*a*, 28*b*, 28*c* are locked in the latching notches 41*a*, 41*b*, 41*c*.

The LED module 2 is thus pressed with the spring force onto the heat sink 11.

The LED circuit board 12 is during the rotation located in the opening 47 of the contacting location 22 and the electrical contact can be manufactured via the contact elements 15.

In addition, other coding means 45 can be provided on the LED module 2. In the outer ring 5 of the mount 1 is provided a coding means 46 as a matching counterpart. It is possible in this case to provide one type of coding wherein different types or combinations of coding means can be used, for instance for different outputs and voltages. Only compatible LED modules 2 can thus be inserted into the mount 1. The coding means on the LED module 2 can be for example a tab 45*a*, or a groove 45*b*. As a counterpart, a recess 46*a* or a bar 46*b* can be provided on the outer ring 5 (shown as hidden in the figures).

Figure 5:
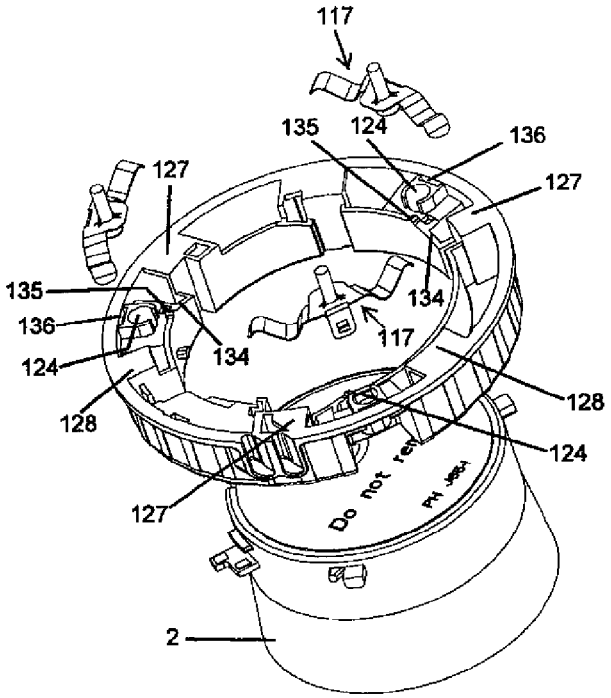
FIG. 5: an exploded view of another device according to the invention provided with the LED module, seen from the rear side of the LED module.
Figure 6:
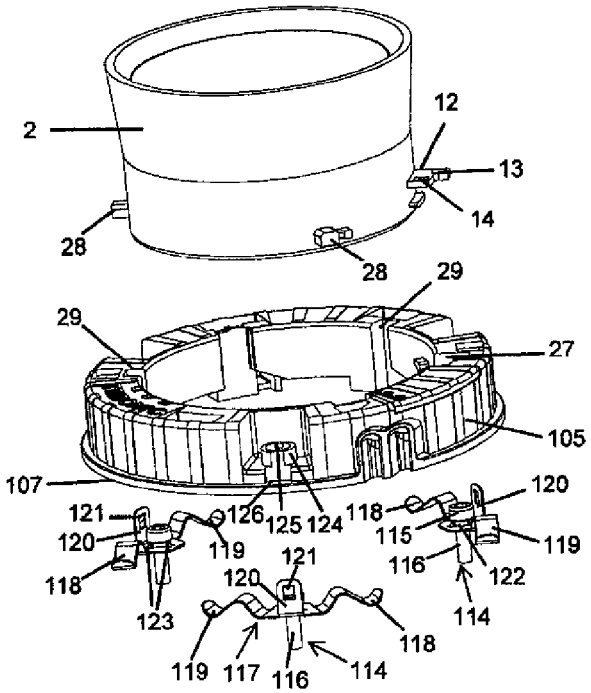
FIG. 6: an exploded view of another device according to the invention provided with the LED module, seen from the front side of the LED module.
Figure 7A:
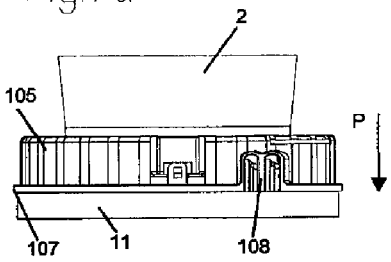
FIGS. 7*a*, 7*b*, 7*c*: a side view, a perspective view and a zoomed-in view of another device according to the invention provided with the LED module during the assembly of the LED module.
Figure 8A:
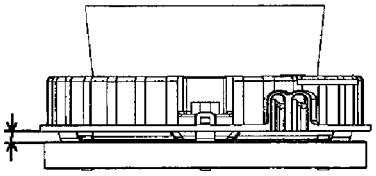
FIGS. 8*a*, 8*b*, 8*c*: a side view, a perspective view and a zoomed-in view of another device according to the invention provided with the LED module in the assembled state of the LED module.
Figure 7B:
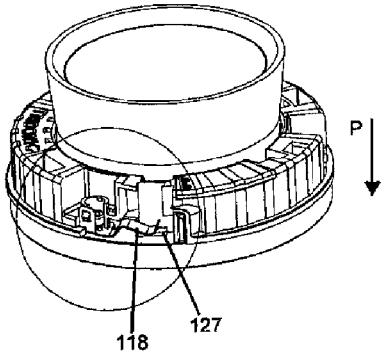
Figure 8B:
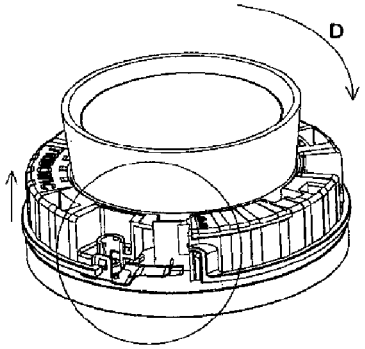
Figure 7C:
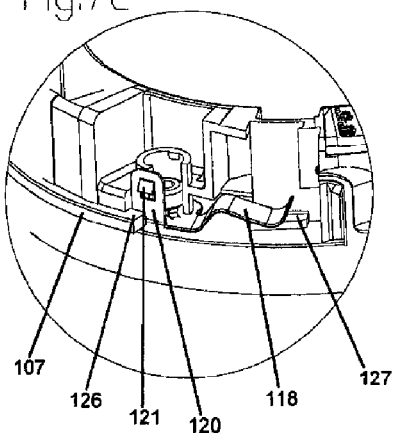
Figure 8C:
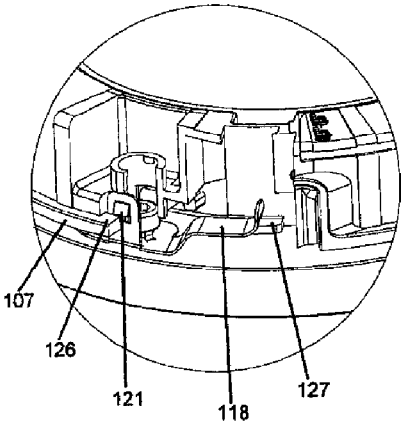
Figure 12A:
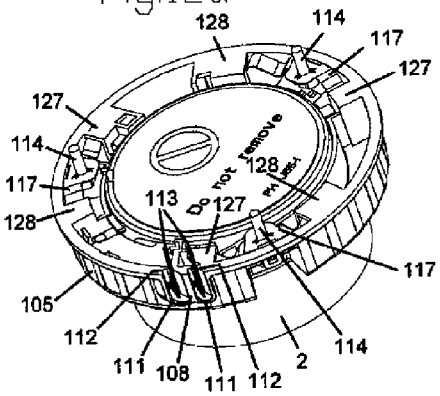
FIG. 12*a*, FIG. 12*b*: perspective views of the variant of FIG. 11*a* and FIG. 11*b* of another device according to the invention provided with the LED module, seen from the rear side of the LED module.
Figure 12B:
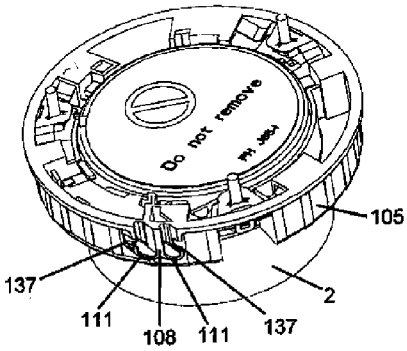
Figure 13:
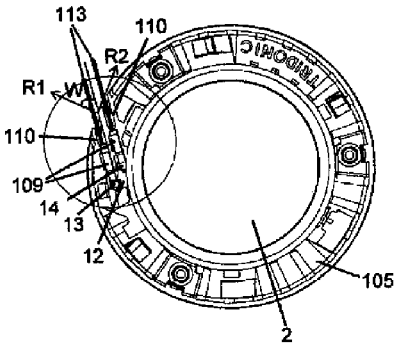
FIG. 13: a front view of another device according to the invention provided with the LED module and with a contacting part, with a zoomed-in view of the contacting part.

FIG. 5 and FIG. 6 show exploded views of another embodiment of the invention which is also described in FIG. 11 through FIG. 13. As can be seen also in FIG. 12, three spring elements 117 are arranged in this example as leaf springs on each fastening means between the device 1 and the heat sink 11, illustrated schematically in FIGS. 7*a* through 8*c*. For the fastening means can be used for example screws 114 of a known type as special screws are not necessarily required. The three screws 114 and three spring elements 117 are distributed uniformly at equal distance around the device. However, more or fewer attachment points could be also provided.

Each spring element 117 has a hole 122, so that tabs 123 are bent around the hole 122. A screw 114 penetrates through the hole 122 of the spring element 117. The tabs 123 are used for height adjustment, so that the screw head 115 could be better guided into the screw hole 124 of the mounting ring 105. The screw head 115 provides a stop for the tabs 123. The tabs 123 are not necessarily required, for example if the screw head are higher. Projections 125 are provided in the upper region of the screw hole 124 to prevent the screw 114 from falling off.

Furthermore, a spring element 117 is provided on the spring leg 117. Two spring legs 118, 119 are provided in this example. At least one part of the spring leg 118, 119 is located on a support surface 127, 128 below the mounting ring 105. The shape of the spring leg 118, 119 is pressing the mounting ring 105 by the spring elements 117 in the direction of the heat sink 11, which is to say in direction P shown in FIGS. 7*a*, 8*a*.

The spring element 117 can be also equipped with a tab 120. A hook 121 is provided on the tab 120. In assembled state, the hook 12 is engaged by on the bar 126 of the outer contour 107 of the mounting ring 105. This prevents the mounting ring 105 from becoming lost and falling out through the screw hole 124. It also prevents overloading the leaf spring 117 since a stop is provided limiting the maximum movement of the spring element 117 in the vertical direction.

During the assembly of the device 1, the screws 114 are loosely positioned in the screw holes 124 of the mounting ring 105. The spring legs 118, 119 are thus supported on support surfaces 127, 128 of the mounting ring 105. The leaf springs are in this case arranged undetachably in the device 1.

It would be also conceivable for the spring elements 117 to be mounted from the other side, wherein they could be inserted into a chamber of the mounting ring.

In the arrangement of the spring elements 117, the tab 120 is deployed, due to the recess 136, behind the screw hole 124 of the mounting ring 105. The retaining means 120 thus acts as a centering element and/or a guide for the spring element 117.

The screws 114 can then be screwed onto the heat sink 11 and the device can thus be attached to the heat sink, although it remains movable in vertical direction P. The device is pressed with the spring force of the spring element 117 onto the heat sink 11. The heat sink 11, illustrated here only schematically, is preferably made of aluminum, and it is necessary when LEDs or LED modules are used in order to dissipate the head produced by LEDs.

The assembly of the LED module 2 in the device is illustrated in FIG. 7*a* through 8*c*.

The LED module 2 is equipped with a retaining element, indicated here as projections 28 which are arranged round the perimeter of the LED module 2. These projections 28 may be a part of an aluminum board in the LED module 2, which is required as an internal heat sink of the LED module 2. In the mounting ring 105 are provided recesses 29 for the retaining means 28. A recess 37 for the LED circuit board 12 of the LED module 2 is created also in the mounting ring 105.

The projections 28 of the LED module can be inserted into the recesses 29 of the device 1 in the assembly direction P. The LED circuit board 12 is at the same time inserted into the recess 27 of the device 1. When other coding means are provided, corresponding recesses should be provided on the device 1 for this coding means.

Subsequently, the LED module is rotated in the rotation direction D. The projections 28 can be deployed along each slotted guide 134 up to each latching notch 135, so that the projections 28 can be locked behind the latching notches 135.

During the tightening of the LED module 2, the rear side of the LED module 2 is pressed onto the heat sink 11 and the mounting ring 105 will be raised by a distance X the tabs 120 of the spring element 117 limit increasing the distance of the mounting ring 105, as do the spring legs 118, 119 which exert a pressing force of the device 1 and of the LED module 2 on the heat sink 11. The LED module 2 is thus pressed onto the heat sink 11.

When the device 1 or the mounting ring 105 is raised, a gap X is created between the heat sink 11 and the device 1. This gap can then additionally help to dissipate heat from the LED module 2. This ventilation is advantageous for the system.

A protective film can be attached to the rear side of the LED module 2, so that on one hand, the LED module 2 will not be damaged during the assembly, and on the other hand both surfaces (the rear side of the LED module and the surface of the heat sink which come into contact) can slide better relative to each other when the LED module 2 is rotated.

Figure 9:
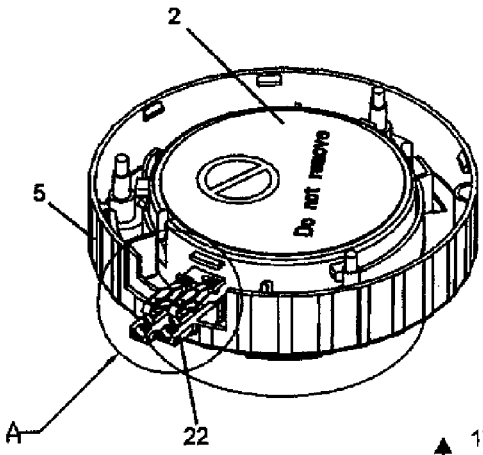
FIG. 9: a perspective view of the contact elements which are in contact with the LED circuit board of the LED module of the first device according to the invention, shown in a zoomed-in view in FIG. 9*a*.
Figure 9A:
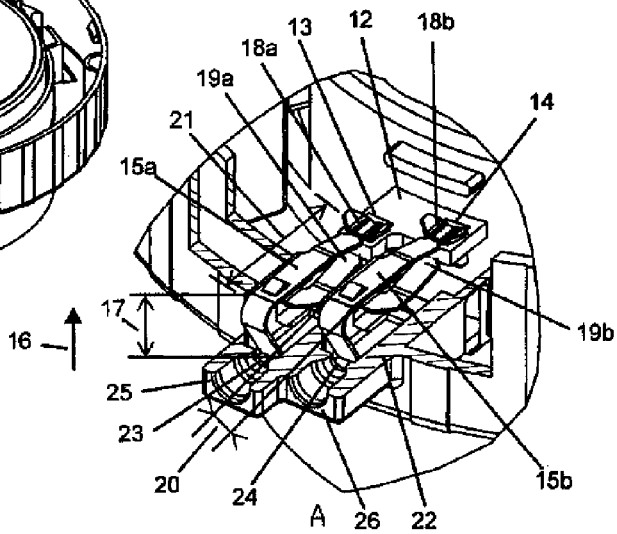

FIG. 9 illustrates the contacting point 22 of the first embodiment. In this location, the LED circuit board 12 of the LED module 2 is contacted with the connection wires 42*a* and 42*b* through the contact elements 15*a*, 15, which are used as sliding contacts. The contacting point 22 is equipped with two chambers 23 and 24, wherein each of the contact elements 15*a* and 15*b* can be stored in one chamber, 23*b* or 24, so that they have the required distance between each other, or they can be separated with a separating wall.

The connection wires 42*a* and 42*b* (not shown in FIG. 9) are respectively inserted into the plug holes 25 and 26 of the chambers 23 and 24. Instead of using connection wires, it is also conceivable that a plug could be inserted. The plug holes 25 and 16 need to be adapted accordingly in such a case.

The connection wires 42*a*, 42*b* come into contact with the contact elements 15*a*, 15*b* on the edgewise side 17 of the contact elements 15*a*, 15*b*.

On the other side of the contact elements 15 are provided spring legs 18 and 19. Between the upper leg 18 and the lower leg 19 of each contact element 15 are clamped contact lugs 13 and 14 of the LED circuit board 12. The contact between the LED circuit board 12 and the connection wires 42 is thus created in this manner.

The arrangement of the contact elements 15 is essential. The positioning of the contact elements 15 with their edgewise sides 17 in the assembly direction 16 means that only a small amount of space is needed for the installation in the horizontal plane for the contacting point.

Since the contact elements 15 are arranged in this manner in the chambers 23, 24, the space required for the installation can be further reduced as there is no risk of undesirable contact between the contact elements 15*a*, 15*b*.

The installation space is optimized with respect to depth as the elongated side 21 of the contact element 15 can be minimized.

The advantage of the small installation space is that, for example, the required recess in the ceiling is thus smaller and/or more space is available for connecting wires.

Figure 10:
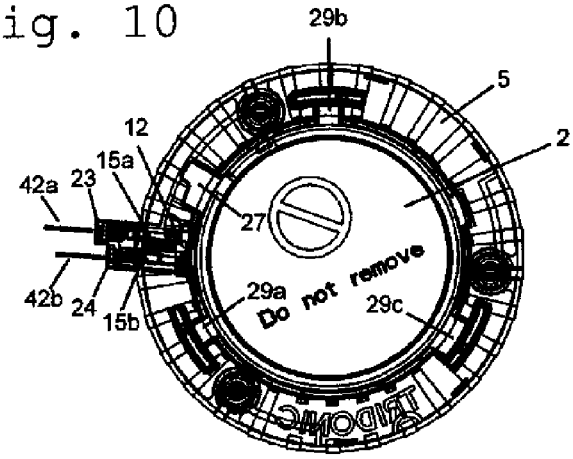
FIG. 10: a top view of the first device according to the invention provided with electrical contacts.

As one can see in the illustrated embodiment, the contact lugs 13 and 14 of the LED circuit board 12 are staggered with respect to their depth. This makes it possible to shift also the position of the plug holes 25, 26 relative to each other as illustrated in FIG. 10. This can be used for protection against reverse voltage.

Figure 11A:
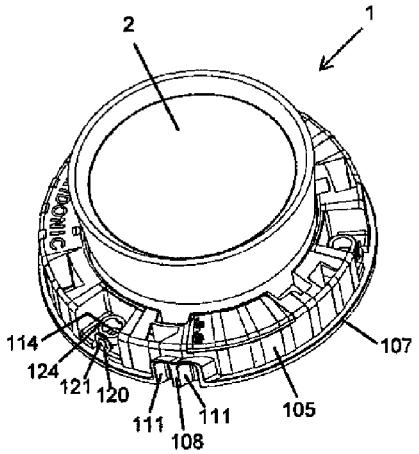
FIGS. 11*a*, 11*b*: perspective views of two variants of another device according to the invention provided with the LED module, seen from the front side of the LED module.
Figure 11B:
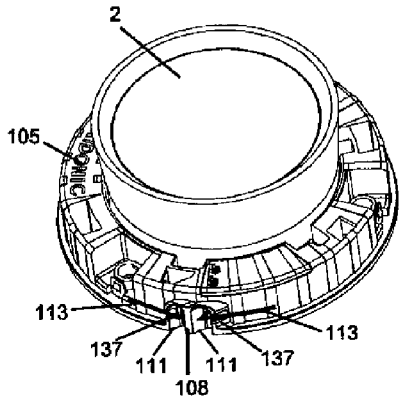

FIGS. 11*a*, 11*b*, as well as FIG. 12*b* show two variants of another embodiment of the device 1 having the LED module 2. In FIG. 12*a* and FIG. 12*b* the rear side of the device 1 and of the LED module 2 can be seen. The LED module 2 was inserted into the device 1, but not yet rotated, which is to say that it is not illustrated in the final assembled state.

The device 1 includes a mounting ring 105, which has at least one spring element 117 and one fastening means 114. The mounting ring 105 can be made of plastic. According to the invention, the device 1 is equipped with an integrated contacting part 108. The electrical conductors are connected in the contacting part to the electrical contact of the LED module.

The plug holes 111 of the contacting part 108 can be seen on the side of the mounting ring 105. It is preferred when two plug holes 111 are provided, so that the contacting part 108 is provided with two separate chambers for the electrical contacts between the conductors 113 and the LED circuit board 12. The plug holes 111 do not exceed the outer contour 107 of the mounting ring 105 when considered in the radial direction. The diameter of the outer contour 107 can be determined for example based on norms or standards. It is possible that the main part of the mounting ring 105 will have a smaller diameter. However, it is advantageous when the contacting part 108 is not projecting beyond the defined outer contour. The overall size of the device 1 is thus reduced.

The electrical conductors 113, as illustrated in FIG. 11*a*, are plugged along the longitudinal axis of the contacting part 108 into the plug holes 111.

On the rear side of the device 1 are in FIG. 12 visible openings 112. They represent an extension of the plug hole 111. Here, the conductors 113 can be inserted horizontally along the longitudinal axis of the contacting part 108 into the plug hole 111 and are subsequently bent in the downward direction, preferably vertically, at about 90°, which is to say perpendicularly or nearly perpendicularly to the radial and tangential direction, due to the openings 112. This should have the same effect as if the electrical conductors were inserted directly from below. It is an essential characteristic of the invention that the introduction of the wires or introduction of the conductors into the device 1 is enabled within the diameter range, without protruding. It could be also conceivable that the electrical conductors 113 are bent in the other direction (direction upward) when the contacting member 108 is configured differently.

Another variant for the transposition of the conductor 113 from the contacting member 108 is illustrated in FIG. 11*b* and FIG. 12*b*. Laterally to the plug holes 111 is provided a recess 137 for continuation of the conductor 113. The conductor 113 can be provided along the mounting ring 105 so that it will nevertheless not protrude from the outer contour 107 of the mounting ring 105. The geometrical design on the exterior of the mounting ring 105 can then be created so that sufficient space can be provided for the conductor 113 along the mounting ring 105 and within the outer contour 107 of the mounting ring 105.

In FIG. 13 is illustrated in a zoomed-in view of a possible arrangement of the contacting part 108 in the mounting ring.

The contacting part 108 is inclined at an angle W to the radial direction R1, as well as arranged obliquely to the tangential direction R2 (at an angle of 90° minus W). The inclination to directions R1 and R2 may depend among other factors on the required length of the contacting part 108. The contact elements 109, in this case in the separate chambers, allow the contact between the contact lugs 13, 14 on the LED circuit board 12 of the LED module 2 and the conductor 113 which can be inserted into the plug holes 111.

Since the contact elements are arranged in separate chamber 110, the space required for the installation can be additionally reduced as there is no risk of an undesirable contact between the contact elements 109.

In the illustrated embodiment, one can see that the contact lugs 13, 14 of the LED circuit board 12 are staggered in depth. This can be used as protection against reversed voltage. With the inclined arrangement of the contact parts 108, two chambers 110 can have a different length in order to compensate for the staggered design.

Figure 14:
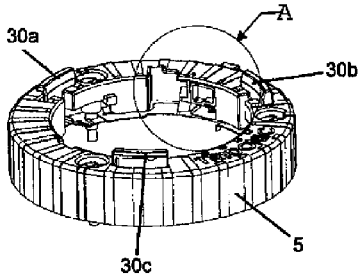
FIG. 14: a perspective view of the outer element of the first device according to the invention with a zoomed-in view of the contact shown in FIG. 14*a*.
Figure 13A:
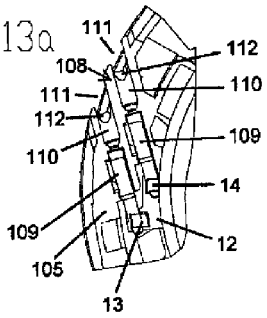
Figure 14A:
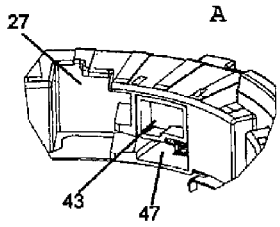

In FIG. 14 and in particular in the zoomed-in view shown in FIG. 14*a* is illustrated a cover 43 for the contacting point 22 within the outer ring 5 of the LED mount 1, shown here according to the first embodiment. This cover 43 is advantageously used as a protection preventing contact between the lighting means and the lighting module, or the LED module and the contacting point 22. The cover 43 also allows the contact elements 15 to remain in their position.

In FIG. 16 and in the zoomed-in view of FIG. 16*a* is illustrated an option for a fastening means between the device 1 and the light 3. The lamp 3 can be mounted directly without any tools on the device or on the LED mount 1. A snap-on mechanism can be used, or the bayonet mount can be employed as is the case here.

The outer ring 5 of the LED mount 1 is equipped with fastening means 30*a*, 30*b*, 30*c*, which are distributed in the vicinity of the outer ring 5. In the lamp 3 are deployed fastening means 31*a*, 31*b*, 31*c* as a counterpart for the fastening means 30*a*, 30*b*, 30*c* of the LED mount 1. The fastening means 31*a*, 31*b*, 31*c* are thus distributed also on the perimeter of the lamp.

Each fastening means 30 is equipped with a slotted guide 34 and with a catching projection 32. Each fastening means 31 is equipped with a slotted guide 36 and with a catching projection 35.

During the mounting of the lamp 3 on the LED mount 1, the slotted guide 36 crosses over the locating projection 33 and the slotted guide 34 until the slotted guide 33 is stopped and locked in the latching notch 35.

The embodiments illustrated in the figure are only examples of the invention. Other embodiments, not shown here, should not be excluded.

FIGURE DESIGNATIONS

1. device
2. LED module
3. lamps
4. ceiling
5. outer ring
6. inner ring
7. screw (7*a*, 7*b*, 7*c*)
8. spring leg (8*a*, 8*b*, 8*c*) and
9. slotted guide (8*d*, 8*e*, 8*f*)
10. hole (9*a*, 9*b*, 9*c*)
11. thread (10*a*, 10*b*, 10*c*)
12. heat sink
13. LED circuit board
14. contact lug
15. contact lug
16. contact element (15*a*, 15*b*)
17. assembly direction
18. edgewise side of 15
19. upper leg (18*a*, 18*b*)
20. lower leg (19*a*, 19*b*)
21. transverse side of 15
22. elongated side of 15
23. contacting point
24. chamber

25. chamber
26. plug hole
27. plug hole
28. recess
29. projection (18*a*, 28*b*, 28*c*)
30. recess
31. fastening means (30*a*, 30*b*, 30*c*)
32. fastening means (31*a*, 31*b*, 31*c*)
33. hook
34. locating projection
35. slotted guide
36. latching notch
37. slotted guide
38. bracket
39. strain relief
40. clamps
41. recess
42. latching notch (41*a*, 41*b*, 41*c*)
43. connecting wire (42*a*, 42*b*)
44. cover of 22
45. rear side of 2
46. coding of 2
47. coding of 5
48. opening of 22
105. mounting ring
107. outer contour of 105
108. contacting part
109. contacting element
110. chamber
111. plug hole
112. opening
113. conductor
114. screw
115. screw head
116. screw thread
117. spring element
118. spring leg
119. screw leg
120. tab
121. screw
122. hole
123. tab
124. screw hole
125. projection
126. bar
127. supporting surface
128. supporting surface
134. slotted guide
135. latching notch
136. recess
137. recess
R1: radial direction
R2: tangential direction
D: direction of rotations
P: assembly direction
W: angle
X: distance between 105 and 11

The invention claimed is:

1. Device for fasting and contacting a lighting device and/or a lighting module, wherein the device (1) is directly fastened to a heat sink, wherein the lighting device and/or the lighting module is removably fastened, by a fastener, in the device (1), the lighting device and/or lighting module is replaceable in the device (1) without tools, wherein the device (1) comprises at least one outer element provided as a mounting ring (5, 105), and at least one inner element; at least one spring element (6, 117), and at least one electrical contacting part (22, 108), wherein the inner element (6) is positioned with a spring on the outer element (5), and the inner element (6) is formed as a resilient element.

2. The device according to claim 1, wherein the inner element (6) is formed as a spring clip, and wherein at least one spring element is provided, as spring legs (8*a*, 8*b*, 8*c*) in the inner element (6).

3. The device according to claim 1, wherein at least one of the inner element or spring element (6, 117) are made from a heat dissipating material.

4. The device according claim 1, wherein at least one spring element (117) is formed as a leaf spring having spring legs (118, 119).

5. The device according to claim 4, wherein the leaf spring is provided with a spring leg (118, 119) which is supported on the mounting ring.

6. The device according to claim 4 wherein at least one spring element (117) is arranged on a fastener (114) of the device (1).

7. The device according to claim 1, for fastening and contacting a lighting device and/or a lighting module having a lamp (3), wherein the device (1) comprises fasteners (30*a*, 30*b*, 30*c*) for the arrangement of the lamp (3), wherein the fasteners (30*a*, 30*b*, 30*c*) enable a tool-free connection with the lamp (3).

8. A lamp (3) comprising a device (1) according to claim 1.

9. The device according to claim 1, wherein the lighting module is an LED module.

10. Device for fasting and contacting a lighting device and/or a lighting module, wherein the device (1) is directly fastened to a heat sink, wherein the lighting device and/or the lighting module is removably fastened, by a fastener, in the device (1), the lighting device and/or lighting module is replaceable in the device (1) without tools, wherein the device (1) comprises at least one outer element provided as a mounting ring (5, 105), and at least one inner element; at least one spring element (6, 117), and at least one electrical contacting part (22, 108), wherein the electrical contact part (108) is provided between the lighting device and/or the lighting module, and electrical conductors (113), wherein the electrical contacting part (108) is arranged on the mounting ring (105) or connected with the mounting ring (105) and comprises contact elements (109), which are in contact with the lighting device and/or lighting module, with an LED circuit board (12), and also with the electrical conductors (113), and the contacting part (108) is integrated in the mounting ring (105).

11. The device according to claim 10, wherein the contacting part (108) is positioned inclined at an angle in the mounting ring (105).

12. The device according to claim 10, wherein the electrical conductor (113) is not projecting, at least in the assembled state, when considered in a radial direction (R1), beyond an outer contour (107) of the mounting ring (105), or of a maximum standard or a standard defined diameter of the mounting ring.

13. The device according to claim 10, wherein the electrical conductors (113) can be bent from the contacting part (108) and when the conductors leave the mounting ring (105), considered in the radial direction (R1), the conductors do not extend beyond the outer contour (107) of the mounting ring (105), or of a maximum standard or a standard defined diameter of the mounting ring.

14. The device according to claim 10, for fastening and contacting a lighting device and/or a lighting module having a lamp (3), wherein the device (1) comprises fasteners (30*a*,

30*b*, 30*c*) for the arrangement of the lamp (3), wherein the fasteners (30*a*, 30*b*, 30*c*) enable a tool-free connection with the lamp (3).

15. A lamp (3) comprising a device (1) according to claim 10.

16. The device according to claim 10, wherein the lighting module is an LED module.

17. Device for fasting and contacting a lighting device and/or a lighting module, wherein the device (1) is directly fastened to a heat sink, wherein the lighting device and/or the lighting module is removably fastened, by a fastener, in the device (1), the lighting device and/or lighting module is replaceable in the device (1) without tools, wherein the device (1) comprises at least one outer element provided as a mounting ring (5, 105), and at least one inner element; at least one spring element (6, 117), and at least one electrical contacting part (22, 108), wherein the electrical contact part (108) is provided between the lighting device and/or the lighting module, and electrical conductors (113), wherein the electrical contacting part (108) is arranged on the mounting ring (105) or connected with the mounting ring (105) and comprises contact elements (109), which are in contact with the lighting means and/or lighting module, with an LED circuit board (12), and also with the electrical conductors (113), and the contacting part (108) is arranged at least when considered in the radial direction (R1) within the outer contour of the mounting ring (105), or a maximum standard or a standard defined diameter of the mounting ring.

18. The device according to claim 17, for fastening and contacting a lighting device and/or a lighting module having a lamp (3), wherein the device (1) comprises fasteners (30*a*, 30*b*, 30*c*) for the arrangement of the lamp (3), wherein the fasteners (30*a*, 30*b*, 30*c*) enable a tool-free connection with the lamp (3).

19. A lamp (3) comprising a device (1) according to claim 17.

20. The device according to claim 17, wherein the lighting module is an LED module.

* * * * *